US008148279B2

(12) United States Patent
Anantharamaiah et al.

(10) Patent No.: US 8,148,279 B2
(45) Date of Patent: Apr. 3, 2012

(54) STAPLE FIBER DURABLE NONWOVEN FABRICS

(75) Inventors: Nagendra Anantharamaiah, Raleigh, NC (US); Behnam Pourdeyhimi, Cary, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 12/421,161

(22) Filed: Apr. 9, 2009

(65) Prior Publication Data

US 2009/0258559 A1 Oct. 15, 2009

Related U.S. Application Data

(60) Provisional application No. 61/044,099, filed on Apr. 11, 2008.

(51) Int. Cl.
*D04H 1/46* (2012.01)
*D04H 3/10* (2012.01)
*D04H 5/02* (2012.01)

(52) U.S. Cl. ..... 442/408; 442/382; 442/383; 442/384; 442/401; 442/402; 442/403; 442/361; 442/362; 442/363; 442/364; 442/340; 442/334

(58) Field of Classification Search ..... 442/382, 442/383, 384, 408, 401, 402, 403, 361–364, 442/340, 334
See application file for complete search history.

(56) References Cited

U.S. PATENT DOCUMENTS 3,485,706 A 12/1969 Evans
4,640,810 A 2/1987 Laursen et al.
5,098,764 A 3/1992 Drelich et al.
5,393,304 A 2/1995 Vuillaume et al.
5,527,171 A 6/1996 Soerensen
5,874,159 A 2/1999 Cruise et al.
5,895,623 A 4/1999 Trokhan et al.
6,105,223 A 8/2000 Brown et al.
6,311,375 B1 11/2001 Patrick (Continued)

FOREIGN PATENT DOCUMENTS

AU 2003204527 A1 12/2004

(Continued)

OTHER PUBLICATIONS

International Search Report for PCT/US2009/040045; Search completed Jul. 31, 2009.

*Primary Examiner* — Norca L Torres Velazquez
(74) *Attorney, Agent, or Firm* — Womble Carlyle Sandridge & Rice, LLP

(57) ABSTRACT

The invention provides durable nonwoven fabrics comprising staple fibers. Methods of preparing durable nonwoven fabrics based on staple fibers are also provided. The methods can include the steps of at least one of needle punching and hydroentangling. The durable nonwoven fabric can be subjected to additional bonding techniques, such as resin bonding and/or thermal bonding. The durable nonwoven fabrics of the invention provide improved durability over conventional nonwoven fabrics. Further advantages of the inventive nonwoven fabrics include maintaining the smooth surface qualities of the fabric and desirable feel of the fabric even with the enhanced durability. The inventive nonwoven fabrics can also be subjected to additional post-processing techniques that conventional nonwoven fabrics would otherwise be unable to withstand. Further, inks and/or dyes can more readily become adhered to the smooth nature of the surfaces of the inventive durable nonwoven fabrics.

24 Claims, 1 Drawing Sheet

U.S. PATENT DOCUMENTS

| | | | | |
|---|---|---|---|---|
| 6,502,288 | B2 * | 1/2003 | Black et al. | 28/104 |
| 6,524,445 | B1 | 2/2003 | Otto et al. | |
| 6,539,596 | B1 * | 4/2003 | Hwo et al. | 28/104 |
| 6,596,658 | B1 | 7/2003 | Putnam et al. | |
| 6,695,941 | B2 | 2/2004 | Hartgrove et al. | |
| 6,739,023 | B2 | 5/2004 | Vonfeldt et al. | |
| 6,790,797 | B1 | 9/2004 | Benim et al. | |
| 6,939,492 | B2 | 9/2005 | Jackson et al. | |
| 7,232,468 | B2 | 6/2007 | Hartgrove | |
| 2002/0028623 | A1 | 3/2002 | Carlson et al. | |
| 2004/0016091 | A1 | 1/2004 | Rivera et al. | |
| 2004/0106342 | A1 * | 6/2004 | Sturm et al. | 442/117 |
| 2005/0278912 | A1 | 12/2005 | Westland et al. | |
| 2006/0035555 | A1 * | 2/2006 | Narayanan et al. | 442/387 |
| 2007/0033779 | A1 * | 2/2007 | Orlandi et al. | 28/100 |
| 2007/0294869 | A1 | 12/2007 | Munstermann | |

FOREIGN PATENT DOCUMENTS

| | | | |
|---|---|---|---|
| JP | 2004019058 | | 1/2004 |
| WO | WO 97/42366 | A2 | 11/1997 |
| WO | WO 00/63478 | | 10/2000 |
| WO | WO 2006/085947 | A2 | 8/2006 |

* cited by examiner

STAPLE FIBER DURABLE NONWOVEN FABRICS

CROSS REFERENCE TO RELATED APPLICATIONS

This application claims priority to U.S. Provisional Patent Application No. 61/044,099, filed on Apr. 11, 2008, which is incorporated by reference herein in its entirety.

FIELD OF INVENTION

The present invention relates to nonwoven fabrics. In particular, the present invention relates to nonwoven fabrics demonstrating superior durability over conventional nonwoven fabrics known in the art while maintaining smoothness of the surface of the fabric.

BACKGROUND OF THE INVENTION

Conventional nonwoven fabrics made from entangled staple fibers are relatively weak and not very durable. Because of these limitations, conventional nonwoven fabrics are mostly used in disposable market segments such as diapers, sanitary napkins, household wipes, fabric dryer sheets, envelopes, and other industry-specific disposable clothing applications. The efficiency through which nonwoven fabrics can be produced gives them an economic advantage over traditional woven or knitted fabrics in these types of disposable applications. Hydroentangled nonwoven fabrics are alternatively known in the art as "spunlace fabrics" or "spunlace."

Conventionally, nonwoven fabrics have been produced through hydroentanglement. Improvements have been made to these hydroentanglement processes to improve the properties of the nonwoven fabric with particular emphasis placed on the durability of the fabric and improved fabric integrity.

It is known in the art that a more durable nonwoven fabric may be achieved by adding bonding agents to the fiber matrix. Traditionally, the fibers of nonwoven fabrics that have been reinforced through bonding have tended to result in fabrics that are stiff. Further, nonwoven fabrics that have been reinforced through the use of bonding agents generally results in the surfaces of the fabric having an undesirable tactile quality. Additionally, the nature of the unsmooth, bonded nonwoven fabric surfaces are less prone to adhering to dyes or inks, which severely limits the extent of additional treatments these fabrics may undergo.

Conventionally, surface effects such as images or patterns have been imparted to nonwoven fabrics by calendaring the formed fabric through, for example, heavy rollers. More recently, hydroentanglement techniques have also been developed to impart images or patterns to the entangled fabric by hydroentangling the fibers on three-dimensional image transfer devices. Images or patterns may be imparted to nonwoven fabrics for reasons of aesthetics and/or for purposes of imparting certain functionality to the nonwoven fabric. For example, an image-laden, durable nonwoven fabric may be used to buff and polish surfaces in, for example, material finishing operations. Also, apertured nonwoven fabrics produced using, for example, a member comprising foramina, even foramina of varying sizes, may be useful to enhance the absorbency characteristics of a product produced therefrom.

There remains in the art a need for a nonwoven material that has increased strength and durability allowing the material to be, for instance, capable of being washed. An additional need that remains in the art is for a high strength, durable nonwoven fabric or cloth that maintains the desirable textile features of conventional nonwoven fabrics or cloths, such as softer feel, and that substantially retains those desirable features after several washings. For example, nonwoven fabrics used in clothing applications, such as, for example, protective clothing applications, must demonstrate sufficient strength and tear resistance that is appropriate to the application. Further, such uses for nonwoven fabrics may require that the materials demonstrate moisture control particularly when the article of clothing manufactured from the nonwoven fabric is to be worn for extended periods of time.

A further need that exists in the art is for processes that can produce a high strength, durable nonwoven fabric or cloth having desirable textile features that is both reliable and economical.

BRIEF SUMMARY OF THE INVENTION

The present invention relates durable nonwoven fabrics. Without intending to be bound by theory, the durable nonwoven fabrics of the invention possess increased strength and durability without compromising the desirable textile features of conventional nonwoven fabrics. The durable nonwoven fabrics can undergo additional processing techniques that conventional nonwoven fabrics could otherwise not withstand either because of their fragile nature or the nature of their surfaces.

In one aspect, the invention provides a durable nonwoven fabric having a web of nonwoven staple fibers, the web of nonwoven staple fibers is needle punched and hydroentangled.

In an embodiment of the invention, the nonwoven staple fibers has at least one fiber type that is a nylon fiber, a PET fiber, a PBT fiber, a PTT fiber, and any combination thereof. Preferably, the at least one fiber type has a concentration of more than about 50% by weight based on the total weight of the web. Other fibers that may be part of the web include fibers that are a variation of the nonwoven staple fibers, co-polyesters, natural fibers such as wool or cotton, man-made cellulosic fibers such as rayon, polyamides, any bicomponent fiber, and any combination thereof.

In certain embodiments of the invention, the web is further subjected to a thermal bonding process. In other embodiments of the invention, the web is subjected to a chemical or resin bonding process. In yet other embodiments of the invention, the web is subjected to a thermal bonding process and a chemical or resin bonding process.

When the web is subjected to a thermal bonding process, the web also comprises at least one low-melting fiber. The at least one low-melting fiber will have a melting point that is below the melting point of the nonwoven staple fibers.

When the web is subjected to a resin bonding process, preferably the resin will be at least one of an acrylic and a polyurethane. More preferably, the acrylic and/or polyurethane resin will have a concentration from about 1% to about 15% by weight based on the total weight of the web.

In an embodiment of the invention, the durable nonwoven fabric successfully undergoes at least one wash cycle according to AATCC test method 61-2A without substantially changing the structural integrity of the web. In yet other embodiments of the invention, the durable nonwoven fabric undergoes at least five wash cycles without substantially changing the structural integrity of the web. In still other embodiments of the invention, the durable nonwoven fabric undergoes at least ten wash cycles without substantially changing the structural integrity of the web.

In an embodiment of the invention, a durable nonwoven fabric will comprise more than one web layer. The more than one web layer is subjected to needle punching, hydroentangling, and at least one of chemical or resin bonding and thermal bonding. Preferably, the multilayer durable nonwoven fabric comprises a first web layer, a third web layer, and a second web layer disposed in between the first web layer and the third web layer. Preferably, the first web layer and the third web layer will each comprise a splittable bicomponent staple fiber. In specific embodiments, the splittable bicomponent staple fiber will have a concentration of at least about 25% by weight based on the total weight of the fiber layer. In other embodiments, the splittable staple fiber will have a concentration of up to about 50% by weight based on the total weight of the fiber layer. The splittable/fibrillatable bicomponent staple fiber has a cross-section of at least one of side by side, sheath-core, tipped trilobal, islands-in-the-sea, segmented pie, islands in the sea, and segmented ribbon.

In other embodiments of the invention, a multilayer durable nonwoven fabric comprises a first web layer, a third web layer, and a second web layer disposed in between the first web layer and the third web layer where the first web layer and the third web layer are both a spunbonded splittable web and the second web is a web comprising a staple fiber.

In other embodiments of the invention, the spunbonded splittable fiber web comprises a splittable bicomponent staple fiber. In an embodiment of the invention, the splittable bicomponent staple fiber of the first web layer and the third web layer and the staple fiber of the second web layer are mechanically bonded. In one embodiment of the invention, the splittable bicomponent staple fiber comprises at least about 25% by weight of the total weight of the fibers comprising the spunbonded splittable fiber web. In other embodiments, the splittable bicomponent staple fiber comprises up to about 50% by weight of the total weight of the fibers comprising the spunbonded splittable fiber web. In other embodiments of the invention, the staple fiber web comprises a staple fiber.

In an embodiment of the invention, at least some of the splittable bicomponent staple fibers are partially split and become entangled with at least some of the staple fibers. In yet another embodiment of the invention, the staple fibers are entangled with at the splittable bicomponent fibers substantially uniform across a surface where the first web layer contacts the second web layer and where the third web layer contacts the second web layer.

Another aspect of the invention provides a product of manufacture comprising the durable nonwoven fabrics of the invention.

Another aspect of the invention provides methods for preparing a durable nonwoven fabric including the steps of producing a carded matrix of a fiber having a substantially uniform basis weight on a web, the fiber having at least one of a staple fiber and a filament; cross-lapping the carded matrix; subjecting the carded matrix to at least one of needle punching and hydroentangling to form an interlaced fibrous structure; and bonding the interlaced fibrous structure through at least one of thermal bonding and chemical or resin bonding to form a bonded fibrous structure.

In another embodiment of the invention, the durable nonwoven fabric formed using the methods described herein, has a ratio of grab tensile strength to basis weight in the machine direction of at least about 0.8 lb-force per gsm, or grams per square meter, of the fabric.

In another embodiment of the invention, the method for preparing a durable nonwoven fabric additionally comprises the step of at least one of hydroentangling and calendering the bonded fibrous structure to provide a desired surface effect to the fabric.

BRIEF DESCRIPTION OF THE DRAWING

Figure 1:
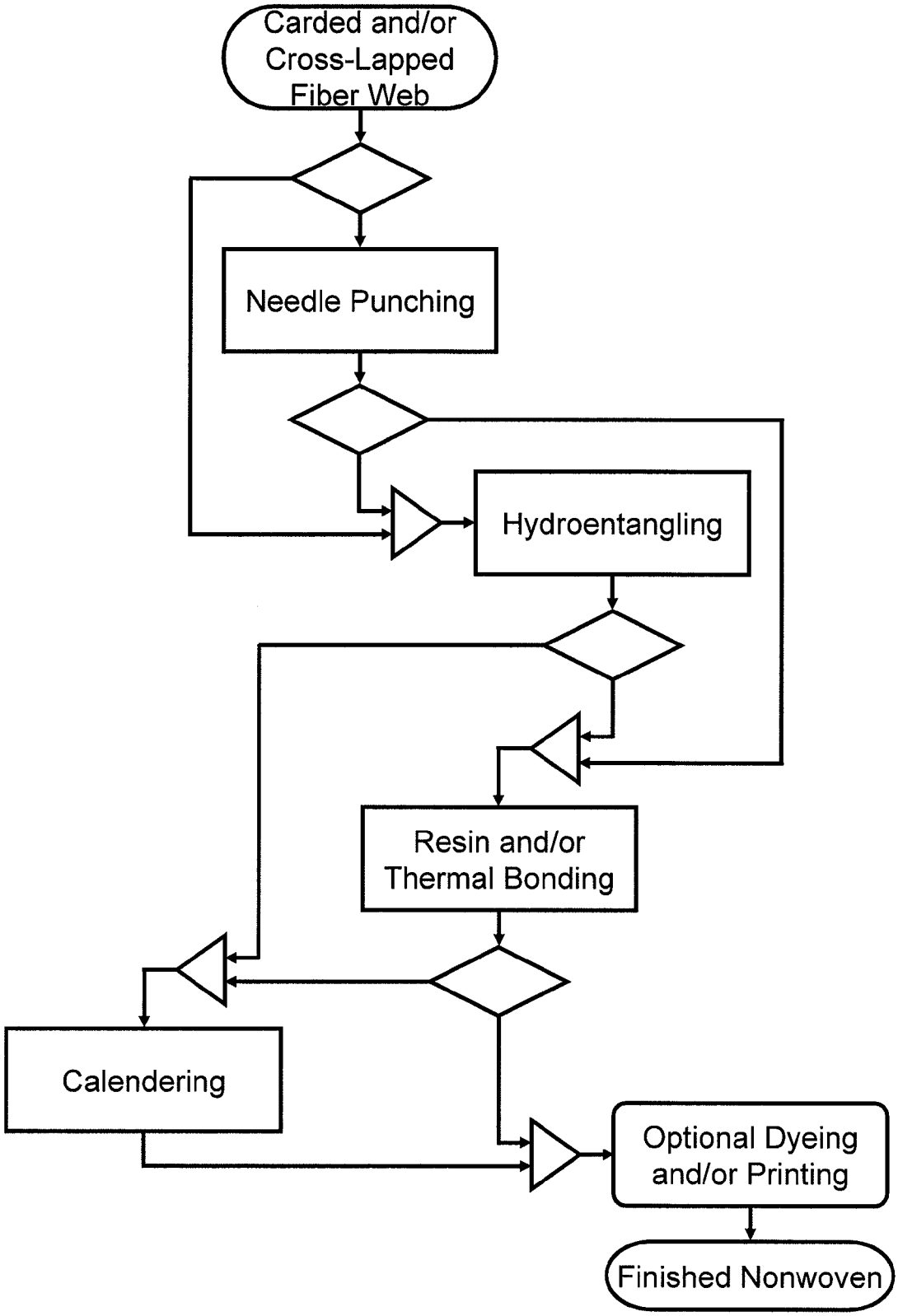

Having thus described the invention in general terms, reference will now be made to the accompanying drawing, wherein:

FIG. 1 is a flowchart of an embodiment of the invention showing the steps of an exemplary process for producing a nonwoven fabric.

DETAILED DESCRIPTION OF THE INVENTION

The present invention now will be described more fully hereinafter with reference to the accompanying drawing, in which some, but not all embodiments of the inventions are shown. Preferred embodiments of the invention may be described, but this invention may, however, be embodied in many different forms and should not be construed as limited to the embodiments set forth herein. Rather, these embodiments are provided so that this disclosure will be thorough and complete, and will fully convey the scope of the invention to those skilled in the art. The embodiments of the invention are not to be interpreted in any way as limiting the invention.

Many modifications and other embodiments of the invention set forth herein will come to mind to one skilled in the art to which this inventions pertain having the benefit of the teachings presented in the descriptions herein and the associated drawings. Therefore, it is to be understood that the inventions are not to be limited to the specific embodiments disclosed and that modifications and other embodiments are intended to be included within the scope of the appended claims.

As used in the specification and in the appended claims, the singular forms “a”, “an”, and “the” include plural referents unless the context clearly indicates otherwise. For example, reference to “a fiber” includes a plurality of such fibers.

Although specific terms are employed herein, they are used in a generic and descriptive sense only and not for purposes of limitation. All terms, including technical and scientific terms, as used herein, have the same meaning as commonly understood by one of ordinary skill in the art to which this invention belongs unless a term has been otherwise defined. It will be further understood that terms, such as those defined in commonly used dictionaries, should be interpreted as having a meaning as commonly understood by a person having ordinary skill in the art to which this invention belongs. It will be further understood that terms, such as those defined in commonly used dictionaries, should be interpreted as having a meaning that is consistent with their meaning in the context of the relevant art and the present disclosure. Such commonly used terms will not be interpreted in an idealized or overly formal sense unless the disclosure herein expressly so defines otherwise.

In one aspect, the invention described herein relates to an improved nonwoven fabric. The improved nonwoven fabric comprises fibers locked into place by various mechanisms including, but not limited to, needle punching, hydroentanglement, and thermal and/or resin bonding. Without intending to be bound by theory, the nonwoven fabric of the invention provides improvements over conventional nonwoven fabrics known in the art by improving the durability of such fabrics while maintaining the smooth surface qualities of the fabric and desirable feel of the fabric. Also, the inventive nonwoven fabric can be subjected to additional post-processing techniques that conventional nonwoven fabrics would otherwise be unable to withstand. For example, the inventive nonwoven fabric can be subjected to jet dyeing techniques, processes that typically impose a great deal of stress on the fabric. Additionally, the smooth nature of the surfaces of the inventive nonwoven fabrics allows inks and/or dyes to more readily become adhered thereto.

Further, nonwoven fabrics that are produced using staple length fibers have the tendency to abrade or pill if not sufficiently entangled or not appropriately bonded with resins or through thermal stabilization. The inventive nonwoven fabric that is the subject of this disclosure avoids this effect. Furthermore, the inventive nonwoven fabric allows the fabric to be cut or sewn without demonstrating any tendency to pill in the cut or broken part of the fabric.

Without intending to be bound by theory, the inventive nonwoven fabrics are characterized by improved physical properties such as, for example, grab tensile strength (e.g., ASTM D5034 that uses a tensile testing machine for measuring the highest tensile load achieved just before a fabric specimen tears or breaks), tongue tear strength (e.g., ASTM D2261 that uses a tensile strength test for measuring the force required to continue a rip through a prepared fabric specimen), air permeability (e.g., ASTM D737 for measuring the standard volume of air drawn through a fabric specimen of a defined area at constant temperature and pressure or the German test standard DIN 53 887 for measuring the quantity of air drawn through a fabric specimen at a fixed vacuum), moisture vapor transmission (e.g., ASTM E96 for measuring transfer of water vapor through a test fabric specimen over a fixed period of time), or any other test commonly used to measure a property related to the strength of a fabric. Such improvements can be realized in the longitudinal or machine direction, the transverse or cross machine direction, or both the longitudinal or machine direction and the transverse or cross machine direction.

In an embodiment of the invention, the grab tensile strength in the machine direction of the nonwoven fabric is at least about 75 lbs, at least about 90 lbs, at least about 100 lbs, at least about 120 lbs, at least about 140 lbs, at least about 160 lbs, at least about 180 lbs, at least about 190 lbs, or at least about 200 lbs. In an embodiment of the invention, the grab tensile strength in the cross machine direction of the nonwoven fabric is at least about 60 lbs, at least about 70 lbs, at least about 80 lbs, at least about 90 lbs, at least about 100 lbs, at least about 110 lbs, at least about 120 lbs, at least about 130 lbs, or at least about 140 lbs. In an embodiment of the invention, the tongue tear strength in the machine direction of the nonwoven fabric is at least about 3.5 lbs, at least about 4.0 lbs, at least about 5.0 lbs, at least about 6.0 lbs, at least about 7.0 lbs, or at least about 8.0 lbs. In an embodiment of the invention, the tongue tear strength in the cross machine direction of the nonwoven fabric is at least about 5.0 lbs, at least about 6.0 lbs, at least about 7.0 lbs, at least about 8.0 lbs, at least about 9.0 lbs, or at least about 10.0 lbs. Alternatively, the grab tensile strength and/or the tongue tear strength may be expressed as a ratio relative to the basis weight of the nonwoven fabric. Such ratios typically being expressed as either in the machine direction or the cross machine direction of the nonwoven fabric in units of lbs of force per grams per square meter or "gsm".

In specific embodiments, the nonwoven fabric of the invention can be specifically described in terms of durability of the fabric. The desired durability is typically established based on, among other things, the application where the fabric is intended to be used or the number of washes the fabric should be capable of sustaining. For example, in certain embodiments of the invention, the nonwoven fabric will be capable of sustaining at least 1 wash, at least 2 washes, at least 3 washes, at least 5 washes, at least 7 washes, at least 10 washes, at least 15 washes, at least 20 washes, at least 25 washes, at least 30 washes, at least 35 washes, at least 40 washes, at least 45 washes, or at least 50 washes under temperature, detergent solution, bleaching, and abrasive action conditions according to AATCC (American Association of Textile Chemists and Colorists) 61 wash test standard 2A for laundering. The durable fabric successfully undergoes one or more washes with no substantial change in the structural integrity of the fabric—i.e., the durable fabric substantially maintains the ability to continue to be used in the application(s) for which it was intended even after undergoing one or more washes.

As used herein, a "staple fiber" means a fiber of finite length. A staple fiber can be a natural fiber or a fiber cut from, for example, a filament.

As used herein, a "filament" refers to a fiber that is formed into a substantially continuous strand.

As used herein, a "nonwoven fabric" means a fabric having a structure of individual fibers or filaments that are interlaid but not necessarily in an identifiable manner as with knitted or woven fabrics.

As used herein, the terms "carding" or "carded web" refers to the process of opening and aligning staple fibers that are first applied in a bulky bat through combing or otherwise treating to produce a web of generally uniform basis weight.

As used herein, the term "cross-lapped" means to spread a loose fiber, for example a filament or yarn, in a back and forth direction that is roughly transverse to the direction of the web on which the fiber is laid with the individual laps partially overlapping each other such that they form an acute angle with each other.

As used herein, "needle punching" means to mechanically entangle a web of either nonbounded or loosely bounded fibers by passing barbed needles through the fiber web.

As used herein, the terms "hydroentangle" or "hydroentangling" refers to a process by which a high velocity water jet or even an air jet is forced through a web of fibers causing them to become randomly entangled. Hydroentanglement may also be used to impart images, patterns, or other surface effects to a nonwoven fabric by, for example, hydroentangling the fibers on a three-dimensional image transfer device such as that disclosed in U.S. Pat. No. 5,098,764 to Bassett et al. or a foraminous member such as that disclosed in U.S. Pat. No. 5,895,623 to Trokhan et al., both fully incorporated herein by reference.

As used herein, the terms "calender" or "calendering" refers to a process for imparting surface effects onto fabrics or nonwoven webs. Without intending to be limiting, a fabric or nonwoven web may be calendered by passing the fabric or nonwoven web through two or more heavy rollers, sometimes heated, under high nip pressures.

The process according to the invention for the production of a nonwoven fabric can comprise any of the following steps: producing a carded matrix of staple fibers, filaments, or combinations thereof having a substantially uniform basis weight on a precursor web; cross-lapping the carded matrix of staple fibers, filaments, or combinations thereof; needle punching the carded and/or cross-lapped web of staple fibers, filaments, or combinations thereof; entangling or interlacing the fibers, such as by hydroentanglement; bonding the fibers through a thermal bonding or resin bonding technique; and hydroentangling or calendaring the formed fabric to provide a desired surface effect to the fabric.

As a person with ordinary skill in the art would understand having the benefit of this disclosure, there are many combinations using any number of the steps of the invention as described above for producing a nonwoven fabric. FIG. 1 is a flowchart illustrating a non-limiting exemplary embodiment of how some of the steps of the invention may be used to produce a nonwoven fabric. In this exemplary embodiment, a carded and/or cross-lapped web of fibers, for example staple fibers, can be subjected to needle punching, hydroentangling, or both needle punching and hydroentangling. Stitch-bonded fibers only subjected to needle punching will be bonded by at least one of resin bonding or thermal bonding. Entangled and interlaced fibrous structures may be directed to a calendering step for imparting texture and/or a surface effect on the nonwoven material. Alternatively, entangled and interlaced fibrous structures may be first bonded by at least one of resin bonding or thermal bonding and then subjected to a calendering step for imparting texture and or a surface effect on the nonwoven material. Fibers only subjected to needle punching will also preferably be subjected to a calendering step for imparting texture and/or a surface effect on the nonwoven material. Optionally, the nonwoven fabric may be subjected to post-treatment processes. Non-limiting examples of post-treatment processes include dyeing, printing, and combinations thereof.

A precursor web is formed embodying a carded fibrous matrix of staple fibers, filaments, yarns, or combinations thereof that has preferably also been cross-lapped. In certain embodiments of the invention, the precursor web may be formed only of a carded fibrous matrix. In other embodiments of the invention, the precursor web may be formed only of cross-lapped fibers.

Exemplary processes for producing a carded web include conventional air-laying processes known in the art such as those disclosed in U.S. Pat. No. 4,640,810 to Laursen et al. and U.S. Pat. No. 5,527,171 to Soerensen. In the air-laying processes, generally, a mat of fibers is fed down a chute into an air-laying apparatus that entrains the fibers into an airstream. Loose fibers fall from the airstream and are collected as a fibrous web material on a forming surface. Another type of carding process comprises the steps of disposing a mass of loose fiber on a supporting structure, repeatedly combing the disposed fibers with a multitude of needles, and repeating these steps until the desired thickness of a carded fibrous matrix is achieved. Any process for producing a carded web now known or later invented may be used in the inventive process for producing nonwoven fabrics. Any cross-lapping apparatus now know or later invented may be used to cross-lap the carded matrix of staple fibers, filaments, or combinations thereof.

In one aspect, the present invention provides a nonwoven fabric. The nonwoven fabric can be formed from a single fiber type or a fiber blend. The nonwoven fabric can be described in terms of a first fiber component and a second fiber component. In certain embodiments of the invention, the first fiber component can comprise 100% by weight of the total fiber content of the nonwoven fabric. For example, while not intending to be limiting, the nonwoven fabric can be formed of a polyester fiber. In other embodiments, the nonwoven fabric can comprise the first fiber component and a certain content of a second fiber component. In other embodiments of the invention, the second fiber component can comprise one or more types of fibers. For example, while not intending to be limiting, the nonwoven fabric can be formed of a polyester/nylon fiber blend. Of course, reference to a first fiber component and a second fiber component does not limit the number of fiber components that can be used to prepare the nonwoven fabric. For example, when the nonwoven fabric is formed of a fiber component in addition to the first fiber component, the nonwoven fabric can be formed of two, three, or even more different types of fibers.

In certain embodiments, the nonwoven fabric comprises a first fiber component that is selected from at least one of a staple fiber, a filament, and any combination thereof. Preferably, the nonwoven fabric comprises a first fiber component that is a staple fiber. More preferably, the nonwoven fabric comprises a first fiber component that includes at least one fiber component comprising a polyester.

In a preferred embodiment of the invention, the nonwoven fabric is formed of a fiber blend comprising a first fiber component having high thermal stability. Preferably, the concentration of the first fiber component having high thermal stability is at least about 50% by weight of the total weight of the fibers. Yet even more preferably, the nonwoven fabric is formed of a fiber blend comprising a first fiber component having high thermal stability wherein the fiber having high thermal stability is the dominant fiber by weight based on the total weight of the fibers. In further embodiments, the first fiber component can comprise at least about 55% by weight, at least about 60% by weight, at least about 65% by weight, at least about 70% by weight, at least about 75% by weight, at least about 80% by weight, at least about 85% by weight, at least about 90% by weight, or at least about 55% by weight of the total weight of the fibers present in the inventive nonwoven fabric. Nonlimiting examples of materials that impart high thermal stability to fibers include man-made cellulosics such as rayon, natural cellulosics such as wool or cotton, polyamides (nylon 6, nylon 6,6, nylon 6,11, nylon 6,12, nylon 11, and nylon 12), polyethylene terephthalate (PET), polybutylene terephthalate (PBT), and polytrimethylene terephthalate (PTT).

The second fiber component (or further fiber components) can be chosen from a variety of fiber types, including natural fibers, synthetic fibers, or a combination thereof. Other types of fibers that can be included in the nonwoven fabric include variations of the fibers as disclosed herein or blends of different fibers including, but not limited to, co-polyesters, natural fibers such as wool or cotton, man-made cellulosic fibers such as rayon, polyamides, or any other bicomponent fiber. In a preferred embodiment of the invention, the nonwoven fabric includes a blend of polyester fibers and co-polyester fibers. More preferably, the concentration of co-polyester fibers will range from about 0.1 wt % to about 20 wt %, from about 0.5 wt % to about 15 wt %, or from about 1 wt % to about 10 wt % all based on the total weight of the fibers.

In certain embodiments, the nonwoven fabric of the invention can comprise a second fiber component that includes a fiber with a melting point that is lower than the melting point of the first fiber component. Accordingly, the first fiber component and the second fiber component can be characterized in terms of their melting point (e.g., a first fiber component having a first melting point and a second fiber component having a second melting point that is less than the first melting point). Likewise, the nonwoven fabric can comprise a bicomponent fiber having a first component and a second component wherein the second component has a melting point that is lower than the melting point of the first component. In another embodiment of the invention, the first component of the bicomponent fiber has a higher thermal stability than that of a second component. Without intending to be bound by theory, such embodiments can be particularly useful to promote thermal bonding within the nonwoven fabric. The difference in the melting points of the fiber components can vary. In certain embodiments of the invention, the lower melting point fiber or component will have a melting point that is only slightly less than the melting point of the high stability fiber or component (e.g., in the range of about 0.5° C. to about 3° C.). In other embodiments of the invention, the difference between the melting point of the lower melting point fiber or component and the melting point of the high melting point fiber or component can be in the range of about 1° C. to about 5° C., about 1° C. to about 10° C., about 1° C. to about 15° C., or about 1° C. to about 20° C. In other embodiments, the difference in melting points can be less than about 20° C., less than about 15° C., less than about 10° C., or less than about 5° C. In a preferred embodiment of the invention, the melting point of the lower melting point fiber or component and the melting point of the high melting point fiber or component will differ by less than about 5° C.

In yet other embodiments of the invention, the nonwoven fabric can include splittable fibers, such as splittable bicomponent fibers, that are designed to split into finer fibers as they are processed. Without intending to be limiting, uses for nonwoven fabrics having splittable fibers include wipes where smaller fibers are useful for picking up small pieces of dust, filtration, and insulation materials.

In other embodiments of the invention, the nonwoven fabric may comprise at least one multicomponent fiber. In a preferred embodiment of the invention, the multicomponent fiber is a bicomponent fiber. In yet another preferred embodiment, the multicomponent or bicomponent fiber has at least one component that is thermally stable as described herein. In another preferred embodiment, the multicomponent or bicomponent fiber has at least once component that is thermally stable that is the dominant component within the multicomponent or bicomponent fiber. For example, the thermally stable component will comprise the 'island' or the 'core' filaments respectively, while the 'sea' or 'sheath' component will enhance the bonding. Such embodiments of the invention can be an effective substitute for the binder fibers, e.g., co-PET, of certain other embodiments of the invention.

Needle punching can be used to better interlock the carded and/or cross-lapped web of staple fibers, filaments, or combinations thereof. Needle punching can improve properties related to, for example, strength, absorption, and resistance to unraveling. The fibrous matrix is fed along a feed path into a needle loom. Any needling loom known in the art may be used in the current invention such as, for example, a Fehrer needle loom or a Jaquard needle loom. A needle loom generally includes a reciprocably moving needle carrier for carrying a series of needles arranged in spaced rows or lines along the length of the carrier. The needle carrier is positioned such that when it is reciprocably engaged with the bed of the fibrous matrix structure, the barbs of the needles engage and pull fibers through the body of the fibrous matrix causing the engaged fibers to intertwine among other fibers within the carded and cross-lapped fibrous matrix. Without intending to be bound by theory, the interlocking that occurs causes the finished fabric to become generally more resistant to unraveling.

In one embodiment of the invention, the needle bed of the needle loom is substantially flat. In another embodiment of the invention, the needle bed of the needle loom is curved. In certain embodiments of the invention, a curved or an arcuate bed can be preferred since it increases the effectiveness of the interlocking that occurs in the fibrous matrix because the needles enter the fibrous matrix structure at varying angles.

Hydroentanglement further serves to entangle or interlace the fibers of the stitch-bonded fibrous structure. The fibers of the stitch-bonded fibrous structure may be interlaced by any hydroentanglement process known in the art. For example, one or more water jets under pressure may be directed at one or both sides of the base fibrous structure to cause the fibers to become entangled in a repeating pattern of localized entangled regions. The localized entangled regions can in turn become interconnected by fibers extending between adjacent entangled regions. In another exemplary process, hydroentanglement includes applying a jet of air to the nonwoven material to dry, cure, and/or bond the fibers of the nonwoven material. While not intending to be limiting, the dwell time, temperature and velocity of the air can be adjusted to achieve the desired degree of entanglement and/or bonding in the nonwoven fabric. An example of such a bonding system includes the rotary and the flatbed THRU-AIR® Systems commercially available from the Honeycomb Division of Metso Paper (Helsinki, Finland).

Hydroentanglement causes the fibers to turn, wind, twist back-and-forth passing about one another in a random but intricate entanglement causing the fibers to become interlocked. Regions of fiber entanglement can extend substantially continuously along straight paths or can be distinct entangled masses of other appearances. Patterns having distinct regions of entangled fibers formed within the fibrous structure can be controlled by the apertures of the supporting web on which the fibrous structure is carried. Repeating patterns of distinct regions of fiber entanglement can be made to be regular wherein substantially identical arrangements are repeated periodically in at least one direction in the plane of the fabric, or the repeating pattern of distinct regions of fiber entanglement can be made to be irregular.

In an embodiment of the invention, the interlaced fibrous structure is thermally bonded through, for example, a thermal stabilization technique. For example, the interlaced fibrous structure may be thermally stabilized by the use of a thermal point bonding technique wherein the web of fibers to be bonded are passed between a heated calender roll and an anvil roll. In certain embodiments of the invention, the heated calender roll can be patterned in some way so that the entire fabric is not bonded across the entire surface resulting in, for example, an aesthetically pleasing fabric. In yet other embodiments of the invention, thermal treatment of the interlaced fibrous structure is accomplished by induction with high-energy waves or by exchange with heated air. Indeed any thermal stabilization technique known in the art may be used to thermally stabilize or bond the fibers of the interlaced fibrous structure.

In an embodiment of the invention, the materials of the fiber can be selected to be, for example, highly exothermic during the thermal stabilization process. Not intending to be bound by theory, as adiabatic overheating of the fibers occurs, heat removal can be hindered by the interlaced fiber matrix causing the fibers to become melted and subjected to further bonding.

In an embodiment of the invention, the interlaced fibrous structure is bonded through a resin bonding technique wherein a sufficient amount of resin is added to the interlaced fibrous structure to achieve a desired strength in the fabric. Non-limiting examples of resins include acrylics, polyurethanes, latexes, and any combination thereof. In one embodiment of the invention, the resin is impregnated in the interlaced fibrous structure. In other embodiments of the invention, the resin is applied by passing the interlaced fibrous structure through a bath of the resin. In yet other embodiments of the invention, the interlaced fibrous structure is sprayed with the resin. Indeed, any process known in the art for applying resins may be used in the invention disclosed herein.

In certain embodiments of the invention, the resin is heated and cured to enhance the strength and the durability of the structure. Preferably, the amount of heat during curing will be sufficient to partially melt a secondary fiber and/or fiber component that has been included in the structure to cause additional bonding to occur within the fibrous structure.

In an embodiment of the invention, the functional groups of the resin, such as, for example, amine groups, epoxy groups, or any combination thereof, are selected to promote the type of bonding that is desired to be achieved in the interlaced fibrous structure. For example, in one embodiment of the invention, the functional groups of the resin are selected to promote bonding within the resin itself. In other embodiments of the invention, the functional groups of the resin are selected to promote bonding with one or more of the types of fibers included in the fibrous structure. In yet other embodiments of the invention, the functional groups of the resin are selected to promote bonding both within the resin itself and with one or more of the types of fibers included in the fibrous structure.

In an embodiment of the invention, the concentration of resin bonding agent included in the nonwoven fabric is less than about 15% by weight of the total weight of the nonwoven fabric. In certain embodiments, the concentration of resin bonding agent included in the nonwoven fabric is less than about 10% by weight of the total weight of the nonwoven fabric. In other embodiments of the invention, the concentration of bonding agent included in the nonwoven fabric is less than about 9%, about 8%, about 7%, about 6%, about5%, about 4%, about 3%, about 2.5%, about 2%, about 1.5%, about 1%, or about 0.5% by weight of the total weight of the nonwoven fabric. In certain embodiments of the invention, the amount of resin applied to the interlaced fibrous structure is chosen based on the durability desired for the finished fabric. Fabric durability can be evaluated by the various means described herein.

Preferably, the resin will have at least one of an acrylic or polyurethane. In some embodiment, the acrylic or polyurethane may have a concentration from about 1% to about 15% by weight based on the total weight of the nonwoven fabric. In other embodiments, the resin having at least one of an acrylic or polyurethane may have a concentration from about 3% to about 5% by weight based on the total weight of the nonwoven fabric.

In yet other embodiments of the invention, the bonding process can be through adhesive bonding, a form of resin bonding. The adhesive may be applied to the interlaced fibrous structure by, for example, slot coating, spray coating, or any other topical application. In yet another embodiment of the invention, pressure sensitive adhesives may added as part of the carded and cross-lapped matrix of staple fibers, filaments, or combinations thereof. As pressure is applied at various points throughout the process, the fibers that become contacted will become bonded. Optionally, pressure may be applied to the interlaced fibrous matrix in for example, a final step, by passing the unfinished fabric through at least one lap roller and pressure roller combination or even through a set of nip rolls to secure other fibers with the pressure sensitive adhesive. When an adhesive is used, preferably it is included in the concentrations described above for resins.

Optionally, an image, pattern, or other surface effect may be imparted to the nonwoven fabric. Techniques for imparting an image, pattern, or surface effect to the nonwoven fabric include hydroentanglement processes as already described herein and calendering. Indeed, any process known in the art for imparting an image, pattern, or surface effect to a web may be used in the current invention.

While images, patterns, or other surface effects may be for aesthetic purposes, such processing techniques can also be used to influence other properties of the nonwoven fabric. For example, calendering the nonwoven may help to smooth the surface of the finished fabric. Calendering may also be useful in achieving a desired thickness of the nonwoven fabric when thickness is important for a particular application. As would be understood by a person having ordinary skill, when the thickness of a formed nonwoven fabric is reduced by a calendering process, the density of the fabric becomes increased. While helping to achieve a certain thickness, calendering can also be useful for eliminating variations in thickness of the nonwoven fabric.

Various operational factors can influence the effect of calendering on a nonwoven web. Such factors can be optimized in order to achieve a desired effect. Without intending to be limiting, the following factors can influence the image, pattern, or other surface effects imparted to the nonwoven web through calendering: number of nips, temperature of the rolls, pressure at the nip, uniformity of temperature and pressure of the nip rollers, processing line speed, types of fibers used in forming the nonwoven fabric, materials of the fibers used in forming the nonwoven fabric, thickness of the nonwoven web, and any combination thereof.

Additionally, the mesh of the belt may be chosen not only to provide a desired texture to the inventive nonwoven fabric but also to affect the desired properties of the inventive nonwoven fabric. As used herein, the term "mesh count" refers to the number of openings per lineal inch of a mesh screen. The openings are delineated by strands, typically plastic threads or wires, in the mesh screen. Optionally, the mesh count may be selected to be substantially the same or different in the longitudinal or machine direction (MD) and the transverse or cross machine direction (CD). Non-limiting examples of properties of the inventive nonwoven fabric that can be affected by patterning imparted by, for example, a belt mesh include grab tensile strength, tongue tear strength, and any combination thereof in at least one direction MD and CD of the inventive nonwoven fabric. In an embodiment of the invention, the mesh size is less than about 100 mesh, less than about 50 mesh, less than about 40 mesh, less than about 30 mesh, less than about 25 mesh, and less than about 20 mesh. In a preferred embodiment, the mesh size is less than about 14 mesh. In another preferred embodiment, the mesh size is substantially equal to about 14 mesh. In yet another preferred embodiment, the mesh is a herringbone mesh screen. In another embodiment of the invention, the diameter of the strands of the mesh screen are selected to achieve a preferred property of the inventive nonwoven fabric, for example, any such property for the nonwoven fabric as disclosed herein.

In an embodiment of the invention, the basis weight, or the weight per unit surface area, of the nonwoven fabric will affect the properties of the nonwoven fabric. In an embodiment of the invention, the basis weight of the fabric will be at least about 100 grams per square meter (gsm), at least about 110 gsm, at least about 120 gsm, at least about 130 gsm, at least about 140 gsm, at least about 150 gsm, at least about 160 gsm, at least about 170 gsm, at least about 180 gsm, or at least about 200 gsm. Without intending to be limiting, generally, when all other factors are constant, increasing the basis weight of the nonwoven fabric will cause the strength or, more specifically, a property measurement related to the strength of the nonwoven fabric to become increased.

In an embodiment of the invention, a 30% increase in the basis weight of the fabric will increase the grab tensile strength in the machine direction by at least about 10%, at least about 15%, at least about 20%, or at least about 25%. In an embodiment of the invention, doubling the basis weight of the fabric will increase the grab tensile strength in the machine direction by at least about 75%, at least about 85%, at least about 95%, at least about 105%, or at least about 115%. In an embodiment of the invention, a 30% increase in the basis weight of the fabric will increase the grab tensile strength in the cross machine direction by at least about 20%, at least about 30%, at least about 40%, or at least about 50%. In an embodiment of the invention, doubling the basis weight of the fabric will increase the grab tensile strength in the cross machine direction by at least about 75%, at least about 100%, at least about 120%, at least about 130%, at least about 140%, or at least about 150%.

In an embodiment of the invention, a 30% increase in the basis weight of the fabric will increase the tongue tear strength in the machine direction by at least about 10%, at least about 20%, at least about 25%, at least about 35%, at least about 45%, or at least about 50%. In an embodiment of the invention, doubling the basis weight of the fabric will increase the tongue tear strength in the machine direction by at least about 50%, at least about 70%, at least about 80%, at least about 90%, or at least about 100%. In an embodiment of the invention, a 30% increase in the basis weight of the fabric will increase the tongue tear strength in the cross machine direction by at least about 5%, at least about 10%, at least about 20%, or at least about 50%. In an embodiment of the invention, doubling the basis weight of the fabric will increase the tongue tear strength in the cross machine direction by at least about 25%, at least about 50%, at least about 60%, at least about 65%, or at least about 75%.

In an embodiment of the invention, the process for producing a nonwoven fabric comprises forming two or more layers of carded and/or cross-linked matrices of staple fibers, filaments, or combinations thereof. The fibers of each of the layers are at least one of needle punched, hydroentangled, interlaced, resin bonded, and thermal bonded. Each of the layers of the nonwoven fabric can also be subjected to at least one of needle punching, hydroentangling, resin bonding, and thermal bonding to form additional fiber-to-fiber bonds.

In a preferred embodiment of the invention, the nonwoven fabric comprises three layers of carded and/or cross-linked matrices of staple fibers. More preferably, a first and a third layer both comprise bicomponent staple fibers and the second layer, disposed between the first layer and the third layer, preferably comprises fibers that are larger than those found in the first layer and the third layer. Preferably, the bicomponent fibers of this embodiment are splittable bicomponent fibers. The bicomponent fibers used in the invention can have any geometric shape. Nonlimiting examples of geometries of bicomponent staple fibers that are useful in the invention include side by side, tipped trilobal, segmented pie, segmented ribbon, and islands of the sea. In addition, a blend of bicomponent fibers that have different geometric shapes may be used in the inventive nonwoven fabric and, for that matter, in any layer of a multilayer embodiment. The first layer or the third layer may be entirely comprised of bicomponent staple fibers. Alternatively, the concentration of bicomponent fibers in the first layer or the third layer is less than about 75% by weight, less than about 60% by weight, less than about 50% by weight, less than about 40% by weight, or less than about 30% by weight all based on the total weight of fibers in either layer. Preferably, the concentration of bicomponent fibers in the first layer or the third layer is more than about 25% by weight based on the total weight of fibers in either layer. In other embodiments of the invention, smaller concentrations of bicomponent fibers may also be useful. In another preferred embodiment of the invention, the first layer or the third layer is at least about 25% by weight based on the total weight of fibers in either layer and is at most about 50% by weight based on the total weight of fibers in either layer. Preferably, the web comprising three layers is needlepunched, hydroentangled, and subjected to at least one of resin bonding or thermal bonding to form additional fiber to fiber bonds.

In another preferred embodiment of the invention, the nonwoven fabric comprises three layers of carded and/or cross-linked matrices of staple fibers as disclosed above, and at least one of the first layer and the third layer is a spunbonded splittable fiber web and the second layer, disposed between the first layer and the third layer, is a staple fiber web, or a web comprising a staple fiber. Preferably, this three-layer web is needlepunched, hydroentangled, and subjected to at least one of resin bonding or thermal bonding to form additional fiber to fiber bonds. In an embodiment of the invention, the spunbonded splittable fiber web comprises a splittable bicomponent fiber and the staple fiber web comprises a staple fiber. In a preferred embodiment of the invention, the splittable bicomponent fiber and the staple fiber are mechanically bonded, for example, through the use of needle punching and/or hydroentangling.

Many variables, even beyond those processing variables as described herein, can impact the characteristics of the nonwoven product produced by the inventive process. Examples of variables that will be determinative of the type of nonwoven product that can be produced include, but are not limited to, the initial material or materials used in the formation of the fibrous web, types and amounts of staple fibers versus filaments used in the formation of the fibrous matrix structure, the patterning that occurs during the carding and cross-lapping steps, the nature and physical characteristics of the fibers used in the formation of the fibrous matrix structure, and the basis weight of the fabric.

In another embodiment, the inventive nonwoven fabrics can include one or more additives. Such additives can include, for example, fire retardants, anti-static agents, antimicrobials, or any other type of additive commonly used in fabrics for personal and commercial use. In an embodiment of the invention, the additives are included in the fibers of the fiber matrix. In another embodiment of the invention, the additives are included in at least one of the fiber types of a fiber blend. In yet another embodiment of the invention, the additive may be disposed substantially at the surface of the fibers of the fiber matrix or the surface of at least one of the fiber types of a fiber blend.

The invention also provides a number of products of manufacture that can be made using the nonwoven fabrics as described herein. Applications where the inventive fabrics can be useful include, but are not limited to, any application where the durability of the inventive nonwoven fabrics is desirable. Such applications include, but are not limited to, clothing or other fabrics where multiple laundering is desired and fabrics where nonwoven materials have traditionally been used.

EXAMPLES

The effect of varying ratios of blended PET and co-PET fibers, varying amounts and types of binder, varying fabric basis weights and several different patterns in finished nonwoven fabrics on the grab tensile strength and the tongue tear strength were measured. Grab tensile strength is a measure of the breaking strength of the fabric and can be measured by the method provided in ASTM D5034. According to ASTM D5034, the fabric sample is placed into a tensile testing machine that grips the fabric with two clamps, and one clamp slowly moves away from the other clamp, which remains stationary. The grab tensile strength is the highest tensile load achieved just before the fabric tears or breaks. Grab tensile strength can be measured in the machine direction and the cross machine direction of the fabric.

Tongue tear strength is a measure of the force required to continue a rip through the fabric and can be measured by the method provided in ASTM D2261. According to ASTM D2261, a rectangular piece of fabric of specific dimensions is slit in the center approximately half-way down the short direction of the fabric. The two ends of the slit piece are subjected to a tensile strength test. The tongue tear strength is the highest tensile load achieved just before the fabric begins to tear or break. Tongue tear strength can be measured in the machine direction and the cross machine direction of the fabric.

Examples 1-4

A nonwoven fabric was prepared with 100 wt % PET fibers (Example 1). Additionally, three nonwoven fabrics were prepared with varying ratios of PET to co-PET fibers—95:5, 90:10, and 80:20 (Examples 2-4, respectively). Each of the nonwoven fabrics included 3 wt % acrylic binder, had a fabric basis weight of 180 grams per square meter (gsm), and were patterned with a 14 mesh screen as disclosed herein using a hydroentangling drum sleeve. The fabrics having co-PET fibers were thru-air bonded at 200° C. Each of the nonwoven fabric samples were tested for grab tensile strength and tongue tear strength in the longitudinal or machine direction (MD) and in the transverse or cross machine direction (CD) according to the test standards noted herein. The results are set forth in Table 1.

TABLE 1

| | 3 wt % acrylic binder, thru-air bonded at 200° C. (except 100% PET), 180 gsm basis weight, 14 mesh pattern Examples | | | |
|---|---|---|---|---|
| Composition/Property | 1 | 2 | 3 | 4 |
| PET Fibers, wt % | 100 | 95 | 90 | 80 |
| Co-PET Fibers, wt % | 0 | 5 | 10 | 20 |
| MD Grab Tensile Strength, lbs | 143 | 159 | 156 | 145 |
| MD Tongue Tear Strength, lbs | 8.8 | 8.0 | 6.7 | 5.5 |
| CD Grab Tensile Strength, lbs | 124 | 131 | 133 | 132 |
| CD Tongue Tear Strength, lbs | 10.3 | 9.7 | 8.6 | 6.6 |

An improvement in grab tensile strength (on the order of approximately 11%) is realized when small concentrations of co-PET fibers—in the range of 5 wt % but perhaps not more than 10 wt %—are included with the PET fibers when tested in the machine direction. A relatively smaller improvement in grab tensile strength—on the order of approximately 7%—is realized when similar concentrations of co-PET fibers are included with the PET fibers when tested in the cross machine direction. The data further shows that co-PET adversely affected the tongue tear strength of the fabrics, but only slightly so at lower concentrations, when tested in both the machine direction and the cross machine direction.

Examples 5-8

Four nonwoven fabrics were prepared having only PET fibers with 3 wt % acrylic binder included. The nonwoven fabrics had the following fabric basis weights (in gsm) and patterning: 100/14 mesh, 130/14 mesh, 200/14 mesh, and 200/Herringbone (Examples 5-8, respectively). Each of the nonwoven fabric samples were tested for grab tensile strength and tongue tear strength in the longitudinal or machine direction (MD) and in the transverse or cross machine direction (CD) according to the test standards noted herein. The results are set forth in Table 2.

TABLE 2

| | 100 wt % Carded Polyester Fibers, 3 wt % Acrylic Binder Examples | | | |
|---|---|---|---|---|
| | 5 | 6 | 7 | 8 |
| Fabric Basis Weight, gsm | 100 | 130 | 200 | 200 |
| Patterning | 14 mesh | 14 mesh | 14 mesh | Herringbone |
| MD Grab Tensile Strength, lbs | 91 | 108 | 170 | 183 |
| MD Tongue Tear Strength, lbs | 3.6 | 5.4 | 7.2 | 7.1 |
| CD Grab Tensile Strength, lbs | 59 | 87 | 141 | 144 |
| CD Tongue Tear Strength, lbs | 5.5 | 5.7 | 9.2 | 7.5 |

Increasing fabric basis weight increases the grab tensile strength of the fabrics. However, the improvement in grab tensile strength in the cross machine direction is more marked than the improvement in grab tensile strength in the machine direction—i.e., 47% versus 19% between the 130 gsm and 100 gsm 14 mesh nonwoven fabrics, and 62% versus 57% between the 200 gsm and 130 gsm 14 mesh nonwoven fabrics. Some improvement in grab tensile strength was realized in going from the 14 mesh patterned fabric to the Herringbone patterned fabric—8% increase for the grab tensile strength in the machine direction and 2% increase for the grab tensile strength in the cross machine direction. Improvements were also recognized in tongue tear strength in both directions; however, the tongue tear strength was adversely impacted in going from the 14 mesh patterned fabric to the Herringbone patterned fabric especially in the measurement for the cross machine direction, which realized an 18% reduction.

Examples 9-12

Four nonwoven fabrics were prepared having only PET fibers with 10 wt % polyurethane binder included. The nonwoven fabrics had the following fabric basis weights (in gsm) and patterning: 100/14 mesh, 130/14 mesh, 200/14 mesh, and 200/Herringbone (Examples 9-12, respectively). Each of the nonwoven fabric samples were tested for grab tensile strength and tongue tear strength in the longitudinal or machine direction (MD) and in the transverse or cross machine direction (CD) according to the test standards noted herein. The results are set forth in Table 3.

TABLE 3

| | 100 wt % Carded Polyester Fibers, 10 wt % Polyurethane Binder Examples | | | |
|---|---|---|---|---|
| | 9 | 10 | 11 | 12 |
| Fabric Basis Weight, gsm | 100 | 130 | 200 | 200 |
| Patterning | 14 mesh | 14 mesh | 14 mesh | Herringbone |
| MD Grab Tensile Strength, lbs | 91 | 113 | 196 | 168 |
| MD Tongue Tear Strength, lbs | 4.7 | 6.1 | 8.0 | 8.2 |
| CD Grab Tensile Strength, lbs | 65 | 96 | 164 | 159 |
| CD Tongue Tear Strength, lbs | 6.3 | 6.5 | 10.2 | 10.0 |

Increasing fabric basis weight increased grab tensile strength of the fabrics. The improvements in grab tensile strength in the machine direction and grab tensile strength in the cross machine direction are nearly the same especially in contrast to the differences seen in the nonwoven fabrics having 3 wt % acrylic binder—i.e., 24% versus 31% between the 130 gsm and 100 gsm 14 mesh nonwoven fabrics, and 73% versus 71% between the 200 gsm and 130 gsm 14 mesh nonwoven fabrics. In stark contrast to the nonwoven fabrics having 3 wt % acrylic binder, the grab tensile strength was negatively impacted in going from the 14 mesh patterned fabric to the Herringbone patterned fabric—14% decrease for the grab tensile strength in the machine direction and a smaller 3% decrease for the grab tensile strength in the cross machine direction. Improvements were also recognized in tongue tear strength in both directions; however, the improvement in the machine direction measurement is immediately realized while the improvements in the cross machine direction are relatively greater at high fabric basis weights. The tongue tear strength was not significantly impacted in going from the 14 mesh patterned fabric to the Herringbone patterned fabric.

Improvements in all values were generally realized with the use of 10 wt % polyurethane binder versus 3 wt % acrylic binder with the exception of 100 gsm/14 mesh grab tensile strength in the machine direction, which was nearly the same, and the 200 gsm/Herringbone grab tensile strength in the machine direction, which shows a sharp reduction. Further, the relative improvement varies based on fabric basis weight and the type of patterning for the nonwoven fabric especially at the lower fabric basis weights.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

All publications mentioned herein, including patents, patent applications, and journal articles are incorporated herein by reference in their entireties including the references cited therein, which are also incorporated herein by reference. The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed.

It will be appreciated by those skilled in the art that changes could be made to the embodiments described herein without departing from the broad inventive concept thereof. Therefore, it is understood that this invention is not limited to the particular embodiments disclosed, but it is intended to cover modifications within the spirit and scope of the present invention as defined by the appended claims.

That which is claimed:

1. A durable nonwoven fabric comprising a web of nonwoven staple fibers having a first fiber component selected from the group consisting of a nylon fiber, a PET fiber, a PBT fiber, a PTT fiber, and combinations thereof, wherein the web is needle punched, hydroentangled, thermally bonded, and calendared.

2. The durable nonwoven fabric of claim 1, wherein the structural integrity of the web remains substantially unchanged after undergoing at least one wash cycle according to AATCC test method 61-2A.

3. The durable nonwoven fabric of claim 2, wherein the structural integrity of the web remains substantially unchanged after undergoing at least five wash cycles.

4. The durable nonwoven fabric of claim 2, wherein the structural integrity of the web remains substantially unchanged after undergoing at least ten wash cycles.

5. The durable nonwoven fabric of claim 1, wherein the web further comprises a second fiber component, the second fiber component including at least one of a co-polyester, a natural fiber, a man-made cellulosic fiber, a polyamide, a bicomponent fiber, and a variation of the first fiber component.

6. The durable nonwoven fabric of claim 5, wherein the first fiber component has a first melting point, and the second fiber component comprises at least one fiber having a second melting point that is less than the melting point of the first fiber component.

7. The durable nonwoven fabric of claim 1, further comprising an acrylic or a polyurethane resin at a concentration from about 1% to about 15% by weight based on the total weight of the durable nonwoven fabric.

8. A durable nonwoven fabric comprising a first web layer, a third web layer, and a second web layer disposed between the first web layer and the third web layer, wherein the web layers are first needle punched and hydroentangled, then at least one of thermally bonded and chemically bonded, and then at least one of calendared and hydroentangled.

9. The durable nonwoven fabric of claim 8, wherein each of the first web layer and the third web layer includes a splittable bicomponent staple fiber such that the entire content of the splittable bicomponent staple fiber comprises from at least about 25% to at most about 50% by weight of the total weight of the fibers comprising the nonwoven fabric.

10. The durable nonwoven fabric of claim 9, wherein the splittable bicomponent staple fiber has a cross-section selected from the group consisting of side by side, tipped trilobal, segmented pie, segmented ribbon, islands in the sea, and combinations thereof.

11. The durable nonwoven fabric of claim 8, wherein each of the first web layer and the third web layer is a spunbonded web comprising a splittable bicomponent fiber and the second web layer comprises a staple fiber, wherein the splittable bicomponent fiber and the staple fiber are mechanically bonded.

12. The durable nonwoven fabric of claim 11, wherein the splittable bicomponent fiber comprises from at least about 25% to at most about 50% by weight of the total weight of the fibers comprising the spunbonded web.

13. The durable nonwoven fabric of claim 11, wherein at least a portion of the splittable bicomponent fibers of the spunbonded web are partially split and are entangled with at least a portion of the staple fibers of the second web layer.

14. A method for preparing a durable nonwoven fabric, the method comprising the following steps:

producing a carded matrix of a fiber on a web, the fiber having a substantially uniform basis weight;

cross-lapping the carded matrix;

subjecting the carded matrix to at least one of needle punching and hydroentangling to form an interlaced fibrous structure;

bonding the interlaced fibrous structure to form a bonded fibrous structure; and at least one of hydroentangling and calendering the bonded fibrous structure to provide a desired surface effect to the fabric.

15. The method of claim 14, wherein said bonding comprises at least one of thermally bonding and chemically bonding.

16. The method of claim 14, wherein the durable nonwoven fabric has a ratio of grab tensile strength to basis weight of at least about 0.8 lb per g/m$^2$ in the machine direction.

17. The durable nonwoven fabric of claim 1, wherein the first fiber component comprises at least about 90% by weight of the fabric.

18. The durable nonwoven fabric of claim 1, wherein the fabric has a basis weight of at least about 130 g/m$^2$.

19. The durable nonwoven fabric of claim 1, wherein the fabric exhibits at least one of the following properties when prepared at a basis weight of at least 130 g/m$^2$: a grab tensile strength in the machine direction (MD) of at least about 100 lbs; a grab tensile strength in the cross machine direction (CD) of at least about 80 lbs; a tongue tear strength in the machine direction (MD) of at least about 5 lbs; a tongue tear strength in the cross machine direction (CD) of at least about 5 lbs.

20. The durable nonwoven fabric of claim 1, wherein the durable nonwoven fabric has a ratio of grab tensile strength to basis weight of at least about 0.8 lb per g/m$^2$ in the machine direction.

21. The durable nonwoven fabric of claim 5, comprising about 5% to about 10% by weight of a co-polyester.

22. The durable nonwoven fabric of claim 8, wherein the durable nonwoven fabric has a ratio of grab tensile strength to basis weight of at least about 0.8 lb per g/m$^2$ in the machine direction.

23. The method of claim 14, the method comprising the following steps:

producing a carded matrix of a fiber on a web, the fiber having a substantially uniform basis weight of at least about 130 g/m$^2$;

cross-lapping the carded matrix;

needle punching the carded matrix to form an interlaced fibrous structure;

hydroentangling the needle punched carded matrix;

bonding the needle punched and hydroentangled fibrous structure to form a bonded fibrous structure; and calendering the bonded fibrous structure to provide a desired surface effect to the fabric;

wherein the prepared durable nonwoven fabric has a ratio of grab tensile strength to basis weight of at least about 0.8 lb per g/m$^2$ in the machine direction.

24. The durable nonwoven fabric of claim 1, wherein the web further comprises a co-polyester as a second fiber component, the co-polyester being present at a concentration of about 1 wt % to about 10 wt % based on the total weight of the fibers present in the fabric.

* * * * *